US011815281B2

(12) United States Patent
Kadowaki et al.

(10) Patent No.: US 11,815,281 B2
(45) Date of Patent: Nov. 14, 2023

(54) AIR-CONDITIONING DEVICE WITH A HEAT MEDIUM HEAT EXCHANGER

(71) Applicant: Mitsubishi Electric Corporation, Tokyo (JP)

(72) Inventors: Kimitaka Kadowaki, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 237 days.

(21) Appl. No.: 17/262,519

(22) PCT Filed: Sep. 26, 2018

(86) PCT No.: PCT/JP2018/035691
§ 371 (c)(1),
(2) Date: Jan. 22, 2021

(87) PCT Pub. No.: WO2020/065766
PCT Pub. Date: Apr. 2, 2020

(65) Prior Publication Data
US 2021/0293440 A1 Sep. 23, 2021

(51) Int. Cl.
*F24F 11/85* (2018.01)
*F24F 1/32* (2011.01)
(Continued)

(52) U.S. Cl.
CPC ..... *F24F 11/85* (2018.01); *F24F 1/32* (2013.01); *F24F 11/83* (2018.01); *F24F 11/84* (2018.01);
(Continued)

(58) Field of Classification Search
CPC ..... F24F 11/83; F24F 11/84; F25B 25/005; F25B 49/02; F25B 2600/2515
See application file for complete search history.

(56) References Cited

U.S. PATENT DOCUMENTS

2014/0150483 A1* 6/2014 Takayama ..... F25B 13/00 62/160
2019/0353401 A1 11/2019 Hikone et al.

FOREIGN PATENT DOCUMENTS

EP 3 367 010 A1 8/2018
EP 3 401 609 A1 11/2018
(Continued)

OTHER PUBLICATIONS

JP 2012-063063 (English translation) (Year: 2012).*
(Continued)

*Primary Examiner* — Jonathan Bradford
(74) *Attorney, Agent, or Firm* — POSZ LAW GROUP, PLC

(57) ABSTRACT

An air-conditioning device includes: a heat medium cycle circuit including: a pump, a plurality of indoor heat exchangers, and a plurality of flow control devices configured to control a flow rate of the heat medium through the heat medium cycle circuit; a heat-source-side device configured to heat or cool the heat medium; and a controller that includes a determination processing unit to determine whether the heat medium is caused to pass through the plurality of indoor heat exchangers where heat exchange is stopped, a selection processing unit to select, based on a determination from the determination processing unit, an indoor heat exchanger through which the heat medium is caused to pass from the plurality of indoor heat exchangers where heat exchange is stopped, and an instruction processing unit to instruct a release of a flow control device that corresponds to the indoor heat exchanger selected.

11 Claims, 6 Drawing Sheets

(51) Int. Cl.

| | |
|---|---|
| ***F25B 49/02*** | (2006.01) |
| ***F24F 11/83*** | (2018.01) |
| ***F24F 11/84*** | (2018.01) |
| *F24F 140/12* | (2018.01) |
| *F24F 140/20* | (2018.01) |
| *F25B 25/00* | (2006.01) |

(52) U.S. Cl.
CPC ..... *F25B 49/02* (2013.01); *F25B 49/022* (2013.01); *F24F 2140/12* (2018.01); *F24F 2140/20* (2018.01); *F25B 25/005* (2013.01); *F25B 2600/13* (2013.01); *F25B 2600/2515* (2013.01)

(56) References Cited

FOREIGN PATENT DOCUMENTS

| | | | |
|---|---|---|---|
| JP | 2012-063063 | A | 3/2012 |
| JP | 2017-053507 | A | 3/2017 |
| WO | 2017/068631 | A1 | 4/2017 |
| WO | 2017/119137 | A1 | 7/2017 |
| WO | 2018/146800 | A1 | 8/2018 |

OTHER PUBLICATIONS

WO 2018/062547 (English translation) (Year: 2018).*
International Search Report of the International Searching Authority dated Nov. 13, 2018 for the corresponding International application No. PCT/JP2018/035691 (and English translation).
Office Action dated Aug. 3, 2021 issued in corresponding JP Patent Application No. 2020-547666 ( and English translation).

* cited by examiner

AIR-CONDITIONING DEVICE WITH A HEAT MEDIUM HEAT EXCHANGER

CROSS REFERENCE TO RELATED APPLICATION

This application is a U.S. national stage application of PCT/JP2018/035691 filed on Sep. 26, 2018, the contents of which are incorporated herein by reference.

TECHNICAL FIELD

The invention relates to an air-conditioning device, and particularly relates to an air-conditioning device that performs air conditioning by causing a heat medium, such as water different from refrigerant, to cycle.

BACKGROUND ART

An air-conditioning device is known where a heat medium cycle circuit is formed between a heat-source-side device and an indoor unit to perform air conditioning, the heat medium cycle circuit allowing a heat medium including water or brine to cycle therethrough. In such an air-conditioning device, the heat-source-side device supplies heat to the indoor unit by heating or cooling the heat medium. The indoor unit heats or cools indoor air with the heat supplied by the heat medium to perform air conditioning (see Patent Literature 1, for example).

An air-conditioning device is known where a heat-source-side device includes a heat exchanger, and the heat exchanger exchanges heat between a heat medium and refrigerant or the like to supply heat to the heat medium. In such an air-conditioning device, it is necessary to cause the heat medium to pass through the heat exchanger at a flow rate equal to or higher than the required passing flow rate by taking into account a pressure loss in a flow passage in the heat exchanger. However, in the case of a low heat load, such as a case where a small number of indoor units are performing air conditioning, it may be unnecessary to supply heat by causing the heat medium to cycle at a flow rate equal to or more than a certain rate.

In view of the above, conventionally, a bypass pipe is connected that bypasses the heat medium inflow port and the heat medium outflow port of the heat exchanger. When a differential pressure detected by a differential pressure gauge or other device becomes a set differential pressure or more, a bypass valve provided to the bypass pipe is released to cause the heat medium flowing out from the heat exchanger to be bypassed to the inflow port, so that the heat medium is not fed to the indoor unit, but is caused to flow back to the heat exchanger.

CITATION LIST

Patent Literature

Patent Literature 1: Japanese Unexamined Patent Application Publication No. 2017-053507

SUMMARY OF INVENTION

Technical Problem

However, in the above-mentioned conventional air-conditioning device where equipment is provided, such as a bypass valve, various costs are required, such as an installation cost, a cost for a place of installation, and time required for trial runs to control the driving of a pump and the bypass valve in a coordinated manner.

The invention has been made to solve the above-mentioned problem, and it is an object of the invention to provide an air-conditioning device that can achieve a reduction in cost.

Solution to Problem

An air-conditioning device according to an embodiment of the invention includes: a heat medium cycle circuit including: a pump configured to pressurize a heat medium including water or brine, and forming a medium that delivers heat, a plurality of indoor heat exchangers configured to exchange heat between the heat medium and indoor air being an object to be air-conditioned, and a plurality of flow control devices provided corresponding to the plurality of indoor heat exchangers, and configured to control a flow rate of the heat medium passing through the plurality of indoor heat exchangers, the pump, the plurality of indoor heat exchangers, and the plurality of flow control devices being connected by pipes to allow the heat medium to cycle through the heat medium cycle circuit; a heat-source-side device configured to heat or cool the heat medium to be fed to the plurality of indoor heat exchangers; and a controller configured to control equipment of the heat medium cycle circuit, wherein the controller includes a determination processing unit configured to determine whether the heat medium is caused to pass through the plurality of indoor heat exchangers where heat exchange is stopped, a selection processing unit configured to select, based on a determination from the determination processing unit, an indoor heat exchanger through which the heat medium is caused to pass from the plurality of indoor heat exchangers where heat exchange is stopped, and an instruction processing unit configured to instruct a release of a flow control device that corresponds to the indoor heat exchanger selected.

Advantageous Effects of Invention

In the embodiment of the invention, the heat medium is caused to pass through the indoor heat exchanger where heat exchange is stopped, thus causing the heat medium to cycle through the heat medium cycle circuit at a flow rate equal to or higher than a required passing flow rate. Therefore, it is unnecessary to provide devices, such as a bypass pipe and a bypass valve, and to perform trial runs to control the bypass valve, so that it is possible to achieve a reduction in cost.

DESCRIPTION OF EMBODIMENTS

Figure 1:
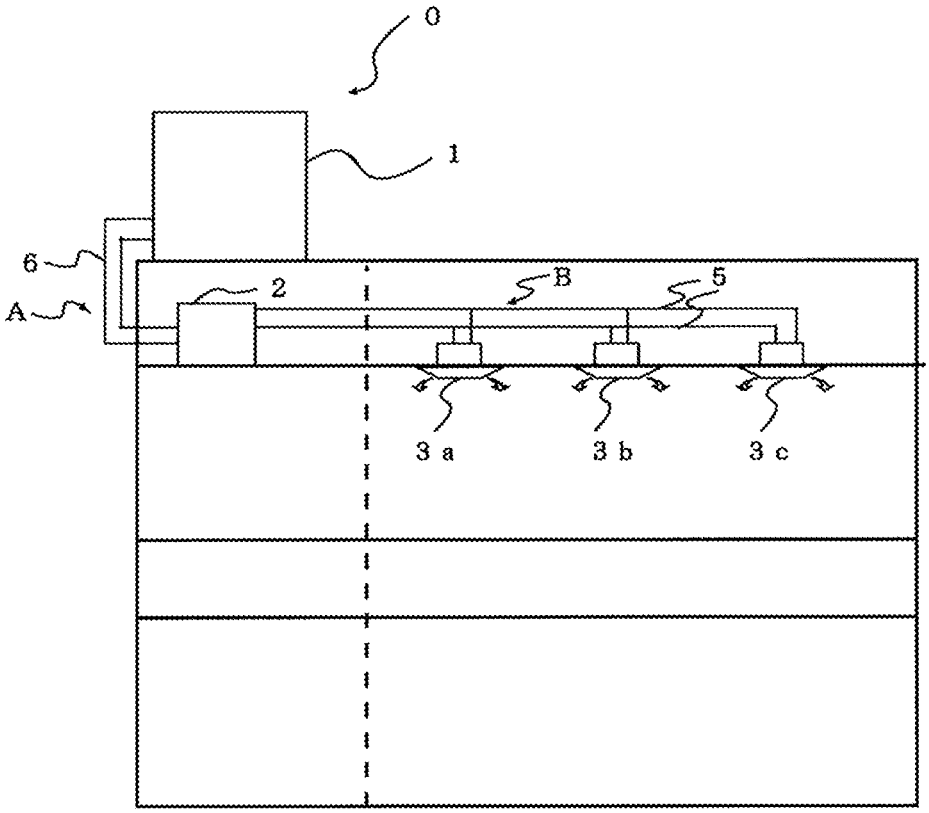
FIG. 1 is a diagram schematically showing an example of an installation of an air-conditioning device 0 according to Embodiment 1 of the invention.

Hereinafter, air-conditioning devices according to Embodiments of the invention will be described with reference to drawings and the like. In the drawings described hereinafter, components given the same reference characters are identical or corresponding components, and the same goes for the entire of Embodiments described hereinafter. In addition, the relationship of sizes of the components in the drawings may differ from that of the actual ones. Further, modes of constitutional elements described in entire DESCRIPTION are merely for the purpose of example, and are not limited to modes described in DESCRIPTION. Particularly, the combination of the constitutional elements is not limited to the combination in each Embodiment, and constitutional elements described in one embodiment may be used in other Embodiments. Further, a high or a low of pressure or temperature is not particularly determined based on the relationship with the absolute value, but is determined relatively based on the state, the operation or the like of the device. For a plurality of equipment of the same kind distinguished from each other by suffixes, the equipment may be described without suffixes or the like when it is unnecessary to distinguish or specify the equipment.

Embodiment 1

FIG. 1 is a diagram schematically showing an example of an installation of an air-conditioning device 0 according to Embodiment 1 of the invention. The example of the installation of the air-conditioning device 0 according to Embodiment 1 will be described with reference to FIG. 1. The air-conditioning device 0 includes a heat-source-side refrigerant cycle circuit A and a heat medium cycle circuit B. The heat-source-side refrigerant cycle circuit A allows heat-source-side refrigerant to cycle therethrough. The heat medium cycle circuit B allows a heat medium, such as water, that transfers, receives, and delivers heat to cycle therethrough. Air conditioning is performed by performing a cooling operation; a heating operation or other operation. The heat-source-side refrigerant cycle circuit A acts as a heat-source-side device that supplies heating energy or cooling energy to the indoor side by heating or cooling a heat medium in the heat medium cycle circuit B.

In FIG. 1, the air-conditioning device 0 according to Embodiment 1 includes one outdoor unit 1 forming a heat source apparatus; a plurality of indoor units 3 (an indoor unit 3*a* to an indoor unit 3*c*) forming indoor units, and a relay unit 2. The relay unit 2 is a unit that relays heat transfer between the heat-source-side refrigerant cycling through the heat-source-side refrigerant cycle circuit A and the heat medium cycling through the heat medium cycle circuit B. The outdoor unit 1 and the relay unit 2 are connected by refrigerant pipes 6 forming flow passages for the heat-source-side refrigerant. It may also be configured such that a plurality of relay units 2 are connected in parallel to one outdoor unit 1. Further; the respective indoor units 3 are connected to the relay unit 2 by heat medium pipes 5 forming flow passages for the heat medium.

As heat-source-side refrigerant that cycles through the heat-source-side refrigerant cycle circuit A, for example, a single refrigerant, such as R-22 or R-134a, a near-azeotropic refrigerant mixture, such as R-410A or R-404A, or a non-azeotropic refrigerant mixture, such as R-407C may be used. It is also possible to use a refrigerant having a relatively small value of global warming potential, such as $CF_3CF{=}CH_2$ containing a double bond in the chemical formula, a mixture containing $CF_3CF{=}CH_2$, or a natural refrigerant, such as $CO_2$ or propane.

As a heat medium that cycles through the heat medium cycle circuit B, for example, brine (antifreeze), water, mixed liquid of brine and water, or mixed liquid of water and additive having a high corrosion resistance effect may be used. As described above, in the air-conditioning device 0 of Embodiment 1, a heat medium with high safety may be used as the heat medium.

Figure 2:
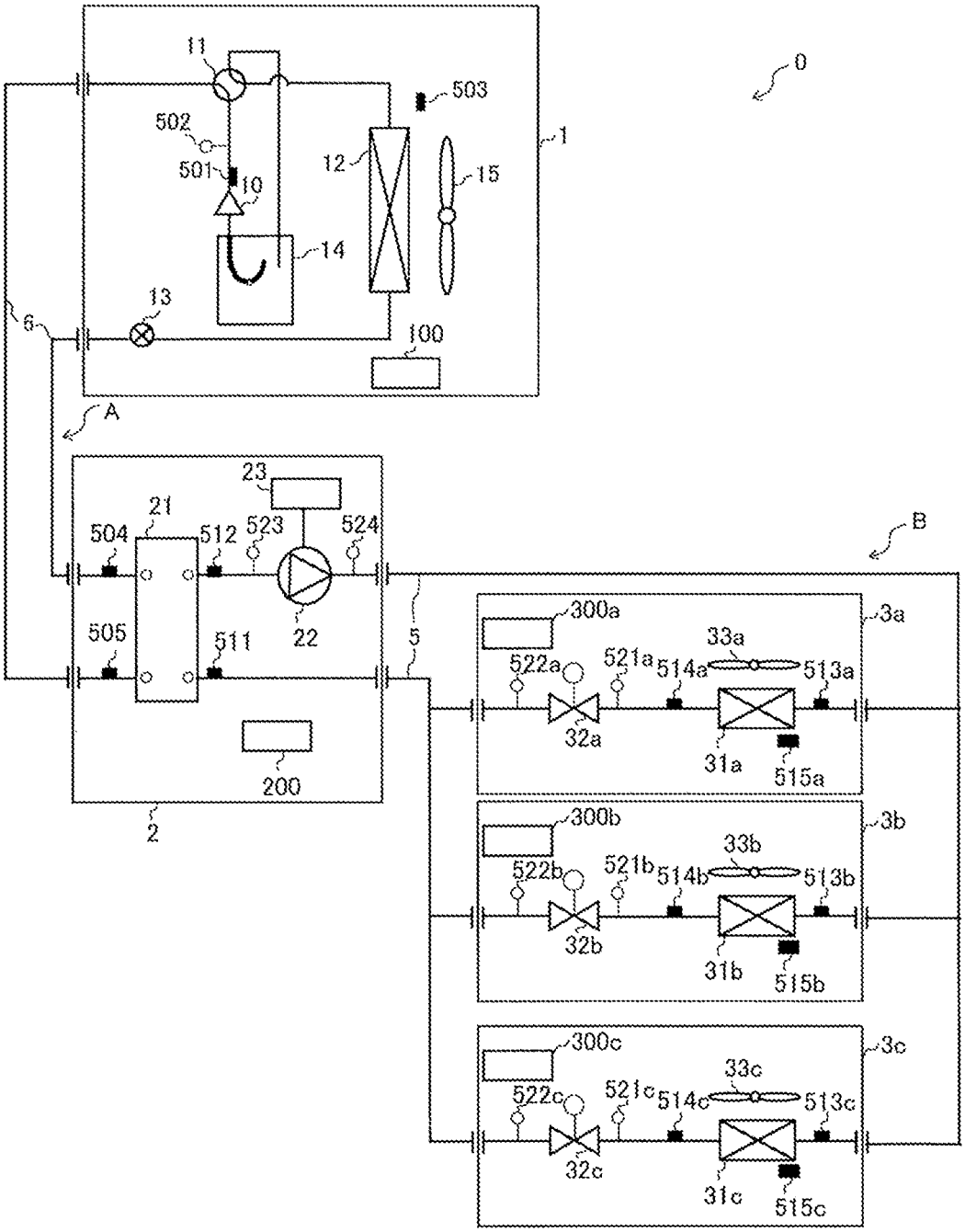
FIG. 2 is a diagram showing one example of the configuration of the air-conditioning device 0 according to Embodiment 1 of the invention.

FIG. 2 is a diagram showing one example of the configuration of the air-conditioning device 0 according to Embodiment 1 of the invention. The configuration of equipment and the like included by the air-conditioning device 0 will be described with reference to FIG. 2. As described above, the outdoor unit 1 and the relay unit 2 are connected by the refrigerant pipes 6. Further, the relay unit 2 and the respective indoor units 3 are connected by the heat medium pipes 5. In FIG. 2, three indoor units 3 are connected with the relay unit 2 via the heat medium pipes 5. However, the number of indoor units 3 connected is not limited to three.

<Outdoor Unit 1>

The outdoor unit 1 is a unit that causes heat-source-side refrigerant to cycle through the heat-source-side refrigerant cycle circuit A to deliver heat and to exchange heat with a heat medium in a heat medium heat exchanger 21 of the relay unit 2, In Embodiment 1, cooling energy is delivered by the heat-source-side refrigerant. The outdoor unit 1 includes, in a housing, a compressor 10, a heat-source-side heat exchanger 12, an expansion device 13, and an accumulator 14, The compressor 10, a refrigerant flow passage switching device 11, the heat-source-side heat exchanger 12, and the accumulator 14 are mounted in a state of being connected by the refrigerant pipes 6. The compressor 10 suctions heat-source-side refrigerant, compresses the heat-source-side refrigerant into a state of high temperature and high pressure, and then discharges the heat-source-side refrigerant. It is preferable that the compressor 10 be an inverter compressor or other compressor whose capacity can be controlled, for example. The refrigerant flow passage switching device 11 is a device that switches flow passages for heat-source-side refrigerant corresponding to a cooling operation mode or to a heating operation mode. In the case where only the cooling operation or the heating operation is performed, it is unnecessary to provide the refrigerant flow passage switching device 11

The heat-source-side heat exchanger 12 exchanges heat between heat-source-side refrigerant and outdoor air supplied from a heat-source-side fan 15, for example. In the heating operation mode, the heat-source-side heat exchanger 12 acts as an evaporator, thus causing heat-source-side refrigerant to receive heat. Further, in the cooling operation mode, the heat-source-side heat exchanger 12 acts as a condenser or radiator, thus causing heat-source-side refrigerant to release heat. The expansion device 13 is a device that acts as a pressure reducing valve or an expansion valve, thus causing heat-source-side refrigerant to expand by decompressing the heat-source-side refrigerant. It is preferable that the expansion device 13 be a device, such as an electronic expansion valve, the opening degree of which can be controlled to a desired degree, thus allowing the flow rate of heat-source-side refrigerant to be desirably controlled, for example. The accumulator 14 is provided at a position close to the suction side of the compressor 10. The accumulator 14 accumulates excess refrigerant, such as refrigerant generated due to the difference in the use amount of refrigerant between the heating operation mode and the cooling operation mode, or refrigerant generated in a transient period, such as when the operation changes, for example. There may also be a case where the accumulator 14 is not provided to the heat-source-side refrigerant cycle circuit A.

<Indoor Unit 3>

The indoor unit 3 is a unit that feeds conditioned air to an indoor space. Each indoor unit 3 in Embodiment 1 includes an indoor heat exchanger 31 (an indoor heat exchanger 31*a* to an indoor heat exchanger 31*c*), an indoor flow control device 32 (an indoor flow control device 32*a* to an indoor flow control device 32*c*), and an indoor-side fan 33 (an indoor-side fan 33*a* to an indoor-side fan 33*c*), The indoor heat exchanger 31 and the indoor flow control device 32 are equipment forming the heat medium cycle circuit B.

The indoor flow control device 32 may be a two-way valve or other valve that can control the opening degree of the valve (the area of an opening port), for example. The indoor flow control device 32 controls the flow rate of a heat medium flowing into and out from the indoor heat exchanger 31 (the amount of the heat medium flowing per unit time) by adjusting the opening degree thereof. Further, based on the temperature of a heat medium flowing into the indoor unit 3 and the temperature of the heat medium flowing out from the indoor unit 3, the indoor flow control device 32 adjusts the amount of the heat medium that is caused to pass through the indoor heat exchanger 31 to allow the indoor heat exchanger 31 to exchange heat by a quantity of heat depending on the heat load in a room. In the case where the indoor heat exchanger 31 is not required to exchange heat with a heat load, such as in a stopped state or a thermo-off state, the indoor flow control device 32 can stop the supply of the heat medium to prevent the heat medium from flowing into or out from the indoor heat exchanger 31 by bringing a valve into a fully closed state. In FIG. 2, the indoor flow control device 32 is provided to a pipe on the heat medium outflow side of the indoor heat exchanger 31. However, the position where the indoor flow control device 32 is provided is not limited to the above. For example, the indoor flow control device 32 may be provided at a position close to the heat medium inflow side of the indoor heat exchanger 31.

The indoor heat exchanger 31 includes a heat transfer tube and fins, for example. A heat medium passes through the heat transfer tube of the indoor heat exchanger 31. The indoor heat exchanger 31 exchanges heat between the heat medium and air in the indoor space supplied by the indoor-side fan 33, When a heat medium having a lower temperature than air passes through the heat transfer tube, air is cooled, so that the indoor space is cooled. The indoor-side fan 33 forms the flow of air that causes the air in the indoor space to pass through the indoor heat exchanger 31 and then return to the indoor space.

<Relay Unit 2>

Next, the configuration of the relay unit 2 will be described. The relay unit 2 is a unit that includes equipment relating to heat transfer between the heat-source-side refrigerant cycling through the heat-source-side refrigerant cycle circuit A and the heat medium cycling through the heat medium cycle circuit B. The relay unit 2 includes the heat medium heat exchanger 21, a pump 22, and an inverter device 23.

The heat medium heat exchanger 21 exchanges heat between the heat-source-side refrigerant and the heat medium to transfer heat from the heat-source-side refrigerant to the heat medium. In the case of heating the heat medium, the heat medium heat exchanger 21 acts as a condenser or a radiator, thus causing heat-source-side refrigerant to release heat. In the case of cooling the heat medium, the heat medium heat exchanger 21 acts as an evaporator, thus causing the heat-source-side refrigerant to receive heat. The pump 22 is a device that suctions the heat medium, and then causes the heat medium to cycle through the heat medium cycle circuit B in a pressurized state. The inverter device 23 suitably varies the driving frequency of power to be supplied to the pump 22 with AC conversion, thus causing the rotation speed of a motor (not shown in the drawing) included by the pump 22 to be finely varied according to the driving frequency. Therefore, by varying the driving frequency, the inverter device 23 can suppress the power consumption of the pump 22 and can prevent a greater than necessary supply of quantity of heat.

The operation of constituent equipment of the air-conditioning device 0 in the heat-source-side refrigerant cycle circuit A will be described based on the flow of heat-source-side refrigerant cycling through the heat-source-side refrigerant cycle circuit A. First, the case of cooling the heat medium will be described. The compressor 10 suctions the heat-source-side refrigerant, compresses the heat-source-side refrigerant into a state of high temperature and high pressure, and then discharges the heat-source-side refrigerant. The discharged heat-source-side refrigerant flows into the heat-source-side heat exchanger 12 via the refrigerant flow passage switching device 11. The heat-source-side heat exchanger 12 exchanges heat between the heat-source-side refrigerant and air supplied by the heat-source-side fan 15 to condense and liquify the heat-source-side refrigerant. The condensed and liquified heat-source-side refrigerant passes through the expansion device 13. The expansion device 13 decompresses the condensed and liquified heat-source-side refrigerant passing through the expansion device 13. The decompressed heat-source-side refrigerant flows out from the outdoor unit 1, passes through the refrigerant pipe 6, and then flows into the heat medium heat exchanger 21 of the relay unit 2. The heat medium heat exchanger 21 exchanges heat between the heat medium and the heat-source-side refrigerant passing through the heat medium heat exchanger 21 to evaporate and gasify the heat-source-side refrigerant. At this point of operation, the heat medium is cooled. The heat-source-side refrigerant flowing out from the heat medium heat exchanger 21 flows out from the relay unit 2, passes through the refrigerant pipe 6, and then flows into the outdoor unit 1. The heat-source-side refrigerant passes through the refrigerant flow passage switching device 11 again, thus being evaporated and gasified. The compressor 10 suctions such heat-source-side refrigerant.

Next, a case of heating the heat medium will be described. The compressor suctions the heat-source-side refrigerant, compresses the heat-source-side refrigerant into a state of high temperature and high pressure, and then discharges the heat-source-side refrigerant. The discharged heat-source-side refrigerant flows out from the outdoor unit 1 via the refrigerant flow passage switching device 11, passes through the refrigerant pipe 6, and then flows into the heat medium heat exchanger 21 of the relay unit 2. The heat medium heat exchanger 21 exchanges heat between the heat medium and the heat-source-side refrigerant passing through the heat medium heat exchanger 21 to condense and liquify the heat-source-side refrigerant. At this point of operation, the heat medium is heated. After the condensed and liquified heat-source-side refrigerant flows out from the heat medium heat exchanger 21, the heat-source-side refrigerant flows out from the relay unit 2, passes through the refrigerant pipe 6, and then passes through the expansion device 13 of the outdoor unit 1. The expansion device 13 decompresses the condensed and liquified heat-source-side refrigerant passing through the expansion device 13. The decompressed heat-source-side refrigerant flows into the heat-source-side heat exchanger 12. The heat-source-side heat exchanger 12 exchanges heat between the heat-source-side refrigerant and air supplied by the heat-source-side fan 15 to evaporate and gasify the heat-source-side refrigerant. The heat-source-side refrigerant passes through the refrigerant flow passage switching device 11 again, thus being evaporated and gasified. The compressor 10 suctions such heat-source-side refrigerant.

The air-conditioning device 0 is also provided with various sensors forming detection devices that detect physical quantities. In the heat-source-side refrigerant cycle circuit A, a discharge temperature sensor 501, a discharge pressure sensor 502, and an outdoor temperature sensor 503 are provided to the outdoor unit 1. The discharge temperature sensor 501 detects the temperature of refrigerant discharged from the compressor 10, and outputs a discharge temperature detection signal. An outdoor unit control device 100 described later obtains the discharge temperature detection signal outputted from the discharge temperature sensor 501. The discharge temperature sensor 501 includes a thermistor and other elements. It is assumed that each of other temperature sensors described hereinafter also includes a thermistor and other elements. The discharge pressure sensor 502 detects the pressure of the refrigerant discharged from the compressor 10, and outputs a discharge pressure detection signal. The outdoor unit control device 100 described later obtains the discharge pressure detection signal outputted from the discharge pressure sensor 502. The outdoor temperature sensor 503 is provided at a portion of the outdoor unit 1 from which air flows into the heat-source-side heat exchanger 12. The outdoor temperature sensor 503 detects an outdoor temperature being the ambient temperature of the outdoor unit 1, and outputs an outdoor temperature detection signal, for example. The outdoor unit control device 100 described later obtains the outdoor temperature detection signal outputted from the outdoor temperature sensor 503.

Further, in the heat-source-side refrigerant cycle circuit A, a first refrigerant temperature sensor 504 and a second refrigerant temperature sensor 505 are provided at positions to the relay unit 2. The first refrigerant temperature sensor 504 is provided to the pipe of the heat-source-side refrigerant cycle circuit A, the pipe being disposed on the refrigerant inflow side of the heat medium heat exchanger 21 in the flow of refrigerant in cooling a heat medium. The first refrigerant temperature sensor 504 and the second refrigerant temperature sensor 505 detects the temperatures of refrigerant flowing into and out from the heat medium heat exchanger 21, and output refrigerant-side detection signals. A relay unit control device 200 described later obtains the refrigerant-side detection signals outputted from the first refrigerant temperature sensor 504 and the second refrigerant temperature sensor 505.

Whereas in the heat medium cycle circuit B, an inflow-port-side heat medium temperature sensor 511 and an outflow-port-side heat medium temperature sensor 512 are provided to the relay unit 2. The inflow-port-side heat medium temperature sensor 511 is provided to the pipe of the heat medium cycle circuit B, the pipe being disposed on the heat medium inflow side of the heat medium heat exchanger 21 in the flow of the heat medium. The inflow-port-side heat medium temperature sensor 511 detects the temperature of a heat medium flowing into the heat medium heat exchanger 21, and outputs a heat-medium-inflow-side temperature detection signal. The relay unit control device 200 described later obtains the heat-medium-inflow-side temperature detection signal outputted from the inflow-port-side heat medium temperature sensor 511. The outflow-port-side heat medium temperature sensor 512 is provided to the pipe of the heat medium cycle circuit B, the pipe being disposed on the heat medium outflow side of the heat medium heat exchanger 21 in the flow of the heat medium. The outflow-port-side heat medium temperature sensor 512 detects the temperature of the heat medium flowing out from the heat medium heat exchanger 21, and outputs a heat-medium-outflow-side temperature detection signal.

In the heat medium cycle circuit B, a pump-inflow-side pressure sensor 523 and a pump-outflow-side pressure sensor 524 are provided to the relay unit 2. The pump-inflow-side pressure sensor 523 is provided to the pipe of the heat medium cycle circuit B, the pipe being disposed on the heat medium inflow side of the pump 22 in the flow of the heat medium. The pump-inflow-side pressure sensor 523 detects the pressure of the heat medium flowing into the pump 22, and outputs a heat-medium-inflow-side pressure detection signal. The pump-outflow-side pressure sensor 524 is provided to the pipe of the heat medium cycle circuit B, the pipe being disposed on the heat medium outflow side of the pump 22 in the flow of the heat medium. The pump-outflow-side pressure sensor 524 detects the pressure of the heat medium flowing out from the pump 22, and outputs a heat-medium-outflow-side pressure detection signal. The relay unit control device 200 described later obtains the heat-medium-inflow-side pressure detection signal outputted from the pump-inflow-side pressure sensor 523 and the heat-medium-outflow-side pressure detection signal outputted from the pump-outflow-side pressure sensor 524.

In the heat medium cycle circuit B, an inflow-port-side indoor temperature sensor 513 (an inflow-port-side indoor temperature sensor 513*a* to an inflow-port-side indoor temperature sensor 513*c*) is provided to each indoor unit 3, An outflow-port-side indoor temperature sensor 514 (an outflow-port-side indoor temperature sensor 514*a* to an outflow-port-side indoor temperature sensor 514*c*) is also provided to each indoor unit 3. The inflow-port-side indoor temperature sensor 513 detects the temperature of the heat medium flowing into the indoor heat exchanger 31, and outputs an inflow-side detection signal. An indoor unit control device 300 included by each indoor unit 3 described later obtains the inflow-side detection signal outputted from the corresponding outflow-port-side indoor temperature sensor 514. Each outflow-port-side indoor temperature sensor 514 detects the temperature of the heat medium flowing out from the indoor heat exchanger 31, and outputs an outflow-side detection signal. The indoor unit control device 300 described later obtains the outflow-side detection signal outputted from the corresponding outflow-port-side indoor temperature sensor 514.

In the heat medium cycle circuit B, an inflow-side indoor pressure sensor 521 (an inflow-side indoor pressure sensor 521*a* to an inflow-side indoor pressure sensor 521*c*) is also provided to each indoor unit 3. An outflow-side indoor pressure sensor 522 (an outflow-side indoor pressure sensor 522*a* to an outflow-side indoor pressure sensor 522*c*) is also provided to each indoor unit 3. The inflow-side indoor pressure sensor 521 and the outflow-side indoor pressure sensor 522 are respectively provided to the heat medium inflow side and the heat medium outflow side of the indoor flow control device 32 of each indoor unit 3, and transmit signals that correspond to the detected pressures. The indoor unit control device 300 included by each indoor unit 3 described later obtains the signals that correspond to the pressures, the signals being outputted from the corresponding inflow-side indoor pressure sensor 521 and the outflow-side indoor pressure sensor 522.

In the air-conditioning device 0 of Embodiment 1, the inflow-side indoor pressure sensor 521 or other sensors of the indoor unit 3, for example, may be omitted. Further, it may be configured such that flow rate detection devices that detect flow rates are installed in place of the respective pressure sensors or together with the respective pressure sensors. It may be also configured such that the heat medium cycle circuit B is provided with a heat quantity detection device that can detect the quantity of heat relating to heat exchange with air in the indoor space being a heat load.

Each indoor unit control device 300 obtains the quantity of heat relating to the heat exchange in the indoor heat exchanger 31 by performing an arithmetic operation or other operation. Then, each indoor unit control device 300 transmits a signal containing data on the obtained quantity of heat to the relay unit control device 200.

An indoor temperature sensor 515 (indoor temperature sensor 515*a* to indoor temperature sensor 515*c*) is also provided to each indoor unit 3. The indoor temperature sensor 515 detects a suction temperature being the temperature of air flowing into the indoor heat exchanger 31 due to the flow of air caused by driving the indoor-side fan 33, and the indoor temperature sensor 515 outputs a suction temperature detection signal. In Embodiment, the suction temperature may be assumed as the temperature of indoor air in the indoor space being a heat load.

Next, the configuration of a control system device of the air-conditioning device 0 according to Embodiment 1 of the invention will be described. As shown in FIG. 2, each unit includes a controller that controls equipment included by each unit. Each controller performs a processing based on data on physical quantities contained in signals transmitted from various sensors, and based on signals for instructions, settings and the like transmitted from an input device (not shown in the drawing) and other devices. Each controller is connected with other controllers by wired communication or by wireless communication, thus being capable of communicating signals containing various data with other controllers. The outdoor unit 1 includes the outdoor unit control device 100. The relay unit 2 includes the relay unit control device 200. Each indoor unit 3 includes the indoor unit control device 300 (an indoor unit control device 300*a* to an indoor unit control device 300*c*).

For communication, in Embodiment 1, each indoor unit control device 300 can transmit signals containing data on pressures, temperatures and the like detected by the sensors in the corresponding indoor unit 3 to the relay unit control device 200 included by the relay unit 2. In addition to the above, each indoor unit control device 300 can transmit, to the relay unit control device 200, data on an indoor set temperature inputted by a remote control (not shown in the drawing), data on the arithmetic operation on the quantity of heat, and other data. Each indoor unit control device 300 can also transmit, to the relay unit control device 200, data on characteristics of equipment included by the corresponding indoor unit 3, such as the heat exchange capacity of the indoor heat exchanger 31.

Figure 3:
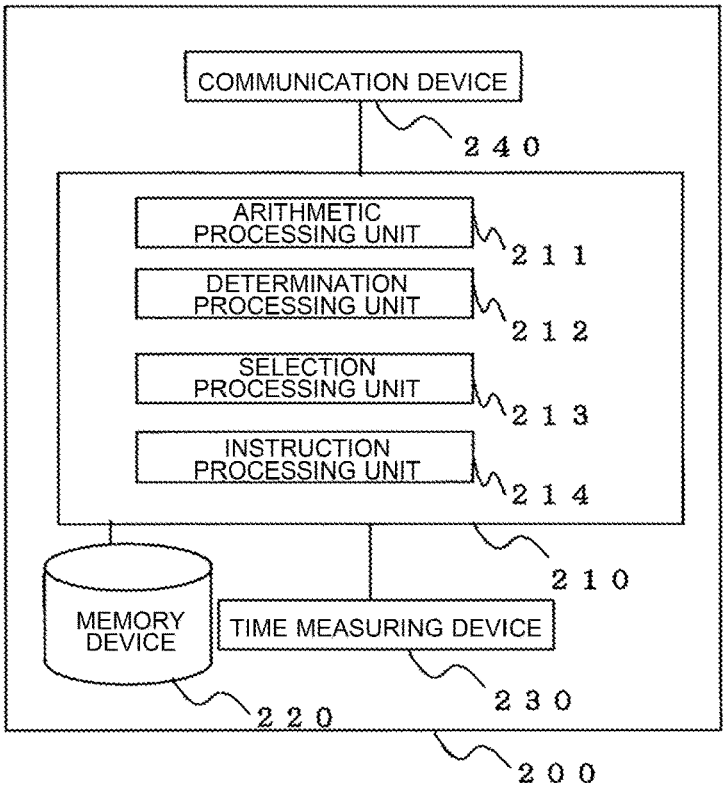
FIG. 3 is a diagram showing the configuration of a relay unit control device 200 according to Embodiment 1 of the invention.

FIG. 3 is a diagram showing the configuration of the relay unit control device 200 according to Embodiment 1 of the invention. As described above, the processing relating to the control in Embodiment 1 is performed by the relay unit control device 200. The relay unit control device 200 includes a control processing device 210, a memory device 220, a time measuring device 230, and a communication device 240.

The memory device 220 stores data used when the control processing device 210 performs a processing. Particularly, the memory device 220 in Embodiment 1 stores data on characteristics of equipment included by each indoor unit 3. The memory device 220 includes a volatile memory device (not shown in the drawing), such as a random access memory (RAM), that can temporarily store data, and a nonvolatile auxiliary memory device (not shown in the drawing), such as a flash memory, that can store data for a long period of time. The memory device 220 also stores a program, and the control processing device 210 executes a processing based on the program to achieve a processing performed by a unit of the control processing device 210.

The time measuring device 230 includes a timer or the like, and the control processing device 210 measures a time of the arithmetic operation or other operation. The communication device 240 is a device forming an interface that converts a signal when the control processing device 210 communicates a signal containing data with the controller of another unit. Hereinafter, it is assumed that the communication between the control processing device 210 and the controller of another unit is performed via the communication device 240.

The control processing device 210 includes an arithmetic processing unit 211, a determination processing unit 212, a selection processing unit 213, and an instruction processing unit 214. The arithmetic processing unit 211 performs various arithmetic processing, such as an arithmetic operation on the differential pressure between a heat medium flowing into the pump 22 and the heat medium flowing out from the pump 22. To cause a heat medium to cycle through the heat medium cycle circuit B at a flow rate equal to or higher than a required passing flow rate, the determination processing unit 212 stops air conditioning brought about by the cooling/heating operation, and determines whether or not it is necessary to cause a heat medium to pass through the indoor heat exchanger 31 of the indoor unit 3 where heat exchange is stopped (hereinafter referred to as the indoor unit 3 in the stopped state). Based on the determination from the determination processing unit 212 and conditions for selection, the selection processing unit 213 performs a selection processing of selecting the indoor unit 3 through which the heat medium is caused to pass. Then, the instruction processing unit 214 performs a processing of transmitting an instruction signal, via the communication device 240, to the indoor unit 3 selected by the selection processing unit 213. In Embodiment, it is assumed that the control processing device 210 is a microcomputer or the like including a control arithmetic processing device, such as a central processing unit (CPU), for example.

Figure 4:
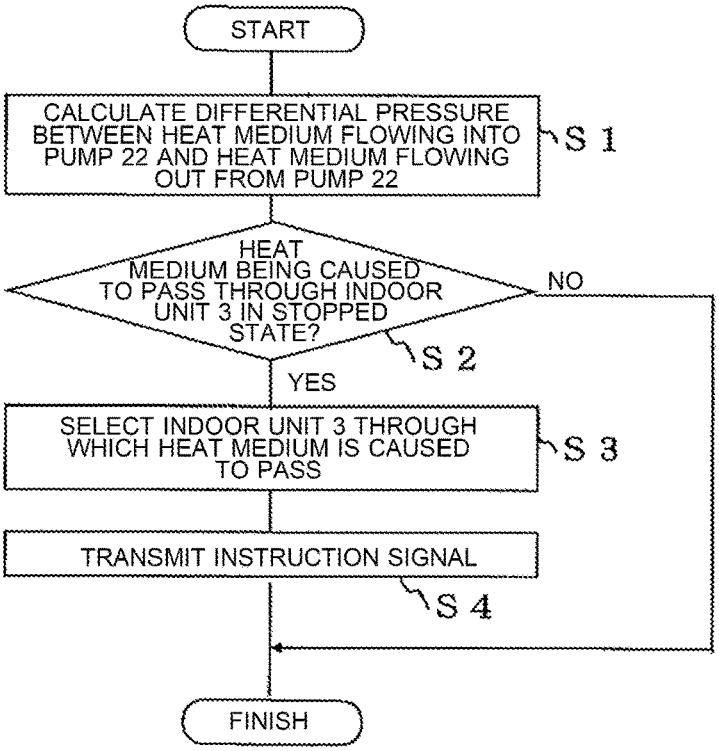
FIG. 4 is a chart showing the flow of a processing for ensuring a required passing flow rate according to Embodiment 1 of the invention.

For example, a reduction in the number of indoor units 3 that is performing the cooling/heating operation reduces the quantity of heat to be supplied from the heat-source-side device to the indoor unit 3. Therefore, the inverter device 23 reduces the flow rate of the heat medium by reducing the rotation speed of a motor of the pump 22 or by performing other operation. However when the flow rate of the heat medium is excessively reduced, the passing flow rate required at the heat medium heat exchanger 21 cannot be ensured. In view of the above, in the air-conditioning device 0 of Embodiment 1, the heat medium is caused to pass through the indoor unit 3 where the operation is stopped to cause the heat medium to cycle through the heat medium cycle circuit B at a flow rate equal to or higher than the passing flow rate required at the heat medium heat exchanger 21, FIG. 4 is a chart showing the flow of a processing for ensuring the required passing flow rate according to Embodiment 1 of the invention. The processing performed by the control processing device 210 of the relay unit control device 200 will be described with reference to FIG. 4. The arithmetic processing unit 211 of the control processing device 210 calculates a differential pressure from the heat-medium-inflow-side pressure detection signal transmitted from the pump-inflow-side pressure sensor 523 and the heat-medium-outflow-side pressure detection signal transmitted from the pump-outflow-side pressure sensor 524 (step S1). Based on the differential pressure calculated by the arithmetic processing unit 211, the determination processing unit 212 of the control processing device 210 determines whether or not it is necessary to cause a heat medium to pass through the indoor unit 3 where air conditioning brought about by the cooling/heating operation is stopped (step S2). When the determination processing unit 212 determines that it is unnecessary to cause the heat medium to pass through the indoor unit 3 in the stopped state, the processing is finished. In Embodiment 1, the determination is made based on a differential pressure. However, it may be configured such that the arithmetic processing unit 211 further performs the arithmetic operation on the flow rate of the heat medium from the differential pressure, and the determination processing unit 212 makes a determination based on the flow rate.

When it is determined that the heat medium is caused to pass through the indoor unit 3 in the stopped state, the selection processing unit 213 of the control processing device 210 performs a processing of selecting one or a plurality of indoor units 3 that satisfies the conditions for selection set in advance (step S3). The condition for selection may be to select the indoor unit 3 that can ensure a required passing flow rate. For example, the capacity of the indoor heat exchanger 31 or the like is set as a specific condition. Alternatively, for example, the condition for selection may be to select the indoor unit 3 that does not affect or slightly affects the temperature of the indoor space or the like even when the heat medium is caused to pass through the indoor unit 3. At this point of operation, for example, the quantity of heat supplied to the indoor unit 3 due to passing of the heat medium, a variation in the temperature of indoor air caused by the quantity of supplied heat or the like may be set as a specific condition. In addition to the above, the condition may be to select the indoor unit 3 in which dew condensation does not occur. In this case, for example, the temperature difference between the temperature of indoor air and the temperature of the heat medium passing through the indoor unit 3 or the like is set as the specific condition. The selection processing unit 213 selects the indoor unit 3 based on data on the respective indoor units 3 stored by the memory device 220, such as characteristics of the indoor units 3, data obtained from the arithmetic processing unit 211 performing arithmetic operations, and other data.

Next, the instruction processing unit 214 of the control processing device 210 transmits an instruction signal to the indoor unit 3 selected by the selection processing unit 213 (step S4). In the indoor unit 3 to which the instruction signal is transmitted, the indoor unit control device 300 causes the heat medium to pass through the indoor unit 3 by releasing the indoor flow control device 32. The relay unit control device 200 performs the above-mentioned processing at set time intervals, for example.

As described above, in the air-conditioning device 0 of Embodiment 1, the determination processing unit 212 of the control processing device 210 of the relay unit control device 200 determines whether or not the heat medium is caused to pass through the indoor heat exchanger 31 of the indoor unit 3 where heat exchange is stopped. Based on the conditions for selection, the selection processing unit 213 selects the indoor unit 3 where air conditioning operation is not performed, and heat exchange in the indoor heat exchanger 31 is stopped. The instruction processing unit 214 transmits an instruction signal to the selected indoor unit 3 to release the indoor flow control device 32. Therefore, it is unnecessary to provide a bypass pipe, a bypass valve and other components that are connected to the heat medium outflow port of the heat medium heat exchanger 21 and, even in the case of the indoor unit 3 having a low heat load, it is possible to ensure a passing flow rate required at the heat medium heat exchanger 21. The bypass valve and other components are not provided, so that an installation cost can be reduced, and it becomes unnecessary to ensure a place of installation. It is also unnecessary to repeatedly perform trial runs to appropriately coordinate the bypass valve with the driving of the pump and hence, it is possible to reduce time required for trial runs. Accordingly, it is possible to achieve a reduction in cost.

Embodiment 2

Figure 5:
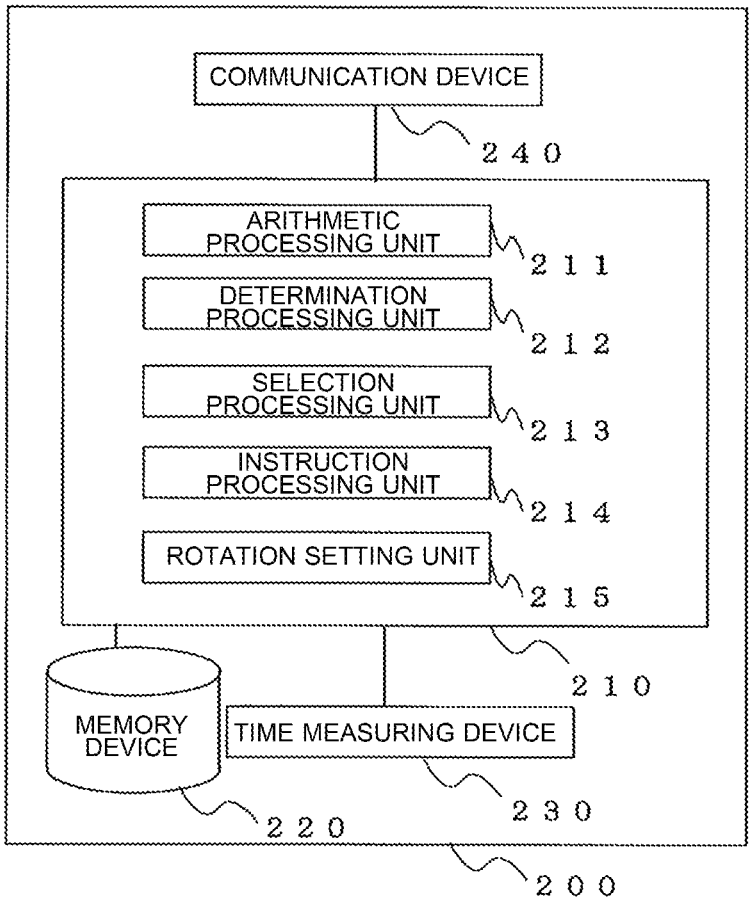
FIG. 5 is a diagram showing the configuration of a relay unit control device 200 according to Embodiment 2 of the invention.

FIG. 5 is a diagram showing the configuration of a relay unit control device 200 according to Embodiment 2 of the invention. In FIG. 5, components given the same reference numeral as the components in FIG. 3 perform an operation or a processing substantially equal to the operation or the processing described in Embodiment 1. As shown in FIG. 5, in the relay unit control device 200 in Embodiment 2, the control processing device 210 further includes a rotation setting unit 215. The rotation setting unit 215 performs a setting processing of switching the indoor units 3 through which a heat medium is caused to pass through at rotation intervals in a predetermined order. Further, the rotation setting unit 215 causes the instruction processing unit 214 to transmit an instruction signal when the rotation setting unit 215 switches the indoor units 3. The rotation interval is not particularly limited. However, in Embodiment 2, the rotation interval is set to a 20-minute interval to a 30-minute interval.

When the temperature of the heat medium passing through the indoor unit 3 is lower than the temperature of indoor air, so that there is a large temperature difference, there may be a case where the temperature in the indoor unit 3 decreases, thus causing dew condensation on a pipe, a housing and the like. In view of the above, in Embodiment 2, passing of the heat medium through the indoor unit 3 where air conditioning is not performed is stopped before dew condensation occurs, and switching is repeatedly performed to cause the heat medium to pass through another indoor unit 3. If switching between two indoor units 3 is repeated, an advantageous effect cannot be obtained. Therefore, it is assumed that the air-conditioning device 0 of Embodiment 2 includes three or more indoor units 3. As described above, the larger the number of indoor units 3 between which switching is performed, the greater the advantageous effect that can be obtained by performing the rotation.

There is also no limitation on a method for determining the order of the rotation of the indoor units 3 performed by the rotation setting unit 215. For example, the rotation may be set such that the heat medium is caused to pass through the indoor units 3 in order of increasing temperature difference between the temperature of the heat medium and the temperature of indoor air.

When the air-conditioning device 0 performs rotation, it is unnecessary to switch the indoor units 3 one by one. It may be configured such that groups consisting of one or a plurality of indoor units 3 are set, and switching is performed by group units. In this case, rotation is performed in a state where three or more groups of the indoor units 3 are formed.

As described above, the air-conditioning device 0 of Embodiment 2 includes the rotation setting unit 215 to allow the rotation of the indoor units 3 through which the heat medium is caused to pass. The rotation is performed such that passing of the heat medium is stopped before dew condensation occurs in the indoor unit 3 through which the heat medium is caused to pass, and the indoor unit 3 is switched to another indoor unit 3. With such rotation, it is possible to prevent the occurrence of dew condensation in the indoor unit 3 through which the heat medium is caused to pass.

Embodiment 3

Figure 6:
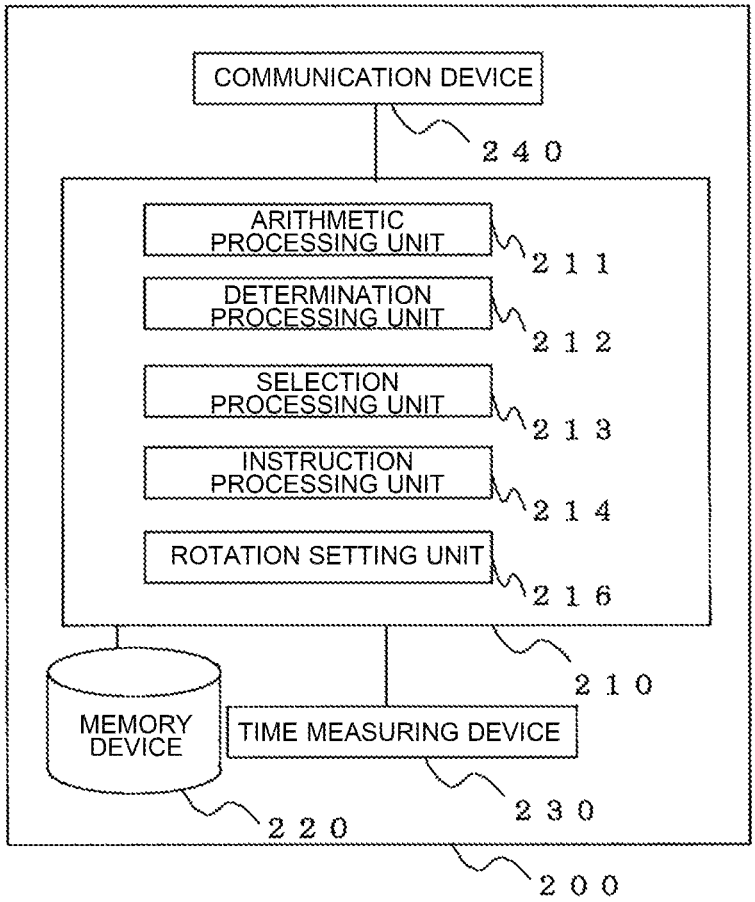
FIG. 6 is a diagram showing the configuration of a relay unit control device 200 according to Embodiment 3 of the invention.

FIG. 6 is a diagram showing the configuration of a relay unit control device 200 according to Embodiment 3 of the invention. In FIG. 6, components given the same reference numeral as the components in FIG. 3 perform an operation or a processing substantially equal to the operation or the processing described in Embodiment 1. As shown in FIG. 6, in the relay unit control device 200 of Embodiment 3, the control processing device 210 further includes a heat medium temperature setting unit 216. In the case where a heat medium is caused to pass through the indoor unit 3 in the stopped state, the heat medium temperature setting unit 216 sets the temperature of the heat medium to be supplied to the indoor unit 3.

In the air-conditioning device 0 of Embodiment 2, the occurrence of dew condensation in the indoor unit 3 is prevented by performing the rotation. As described above, in the case where the air-conditioning device 0 includes a small number of indoor units 3 between which switching can be performed, the air-conditioning device 0 may not exhibit an advantageous effect of preventing the occurrence of dew condensation. In view of the above, in the air-conditioning device 0 of Embodiment 3, the heat medium temperature setting unit 216 sets the temperature of the heat medium to be supplied to the indoor unit 3 when one indoor unit 3, for example, is selected by the selection processing unit 213.

At this point of operation, the heat medium temperature setting unit 216 sets the temperature of the heat medium such that there is a small temperature difference between the temperature of the heat medium and the temperature of indoor air. Therefore, when a cooled heat medium is supplied to the indoor unit 3, the heat medium temperature setting unit 216 sets the temperature of the heat medium such that the temperature of the heat medium becomes higher than the current temperature of the heat medium. Whereas when a heated heat medium is supplied to the indoor unit 3, the heat medium temperature setting unit 216 sets the temperature of the heat medium such that the temperature of the heat medium becomes lower than the current temperature of the heat medium. In the air-conditioning device 0, based on the temperature of the heat medium set by the heat medium temperature setting unit 216, the quantity of heat is supplied from the heat-source-side refrigerant cycle circuit A to the heat medium heat exchanger 21 to perform the cooling or heating operation, By reducing the temperature difference between the temperature of the heat medium and the temperature of indoor air, it is possible to improve the resistance of the indoor unit 3 to dew condensation, Although the quantity of heat to be supplied to indoor air, being an object to be air-conditioned, reduces, the indoor unit 3 that is performing air conditioning can supply the quantity of heat little by little.

Embodiment 4

Figure 7:
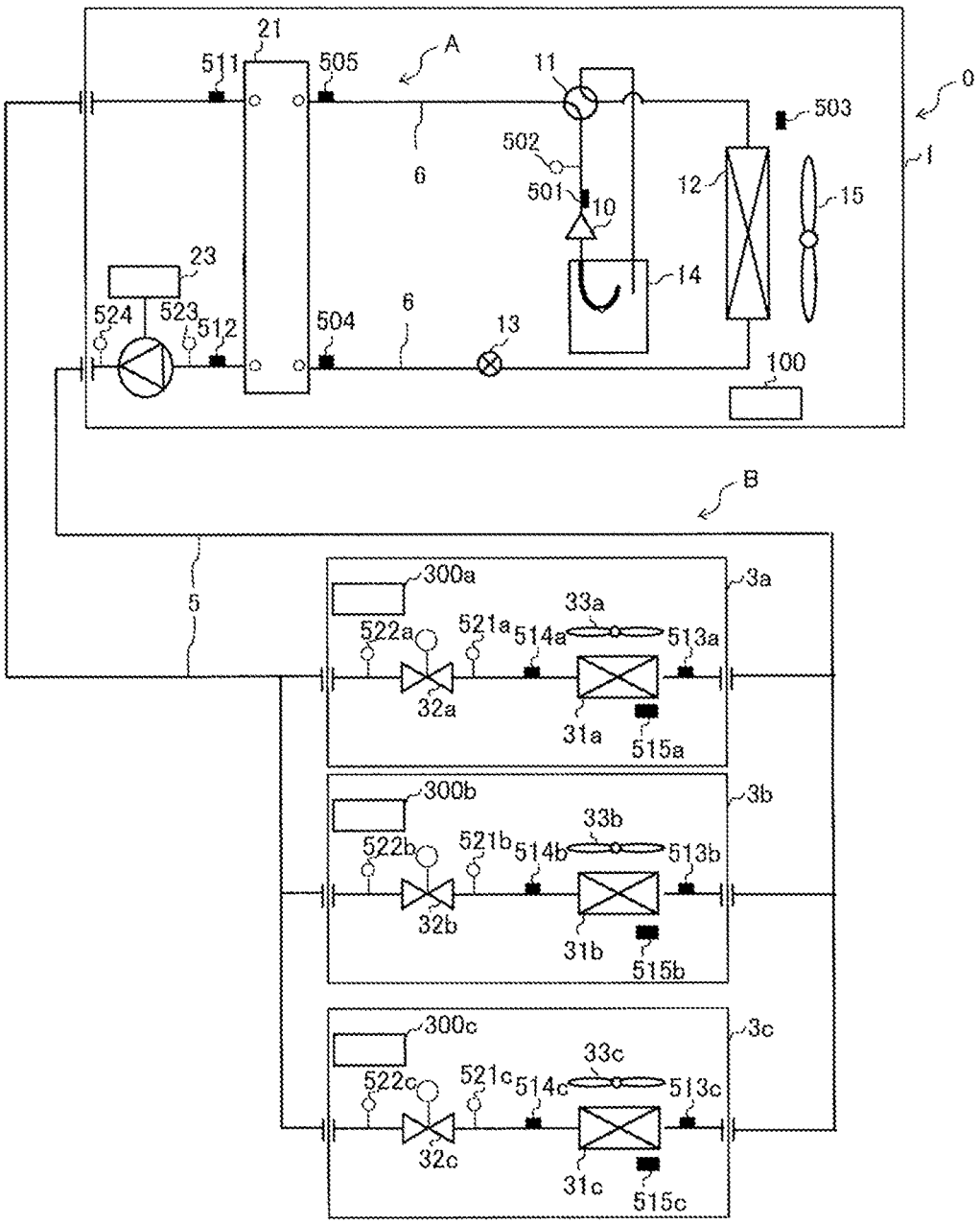
FIG. 7 is a diagram showing one example of the configuration of an air-conditioning device 0 according to Embodiment 4 of the invention.

FIG. 7 is a diagram showing one example of the configuration of an air-conditioning device 0 according to Embodiment 4 of the invention. In FIG. 7, equipment given the same reference numeral as the equipment in FIG. 2 perform an operation substantially equal to the operation described in Embodiment 1 or other Embodiments. The air-conditioning device 0 of Embodiment 4 is obtained such that equipment in the relay unit 2 described in Embodiment 1 and Embodiment 2 is included by the outdoor unit 1 to form an integral body. Therefore, in the air-conditioning device 0 of Embodiment 5, the outdoor unit 1 and the respective indoor units 3 are connected by the heat medium pipes 5. The pump 22 and the inverter device 23 in the heat medium cycle circuit B are provided in the outdoor unit 1. The outdoor unit 1 accommodates all equipment of the heat-source-side refrigerant cycle circuit A, so that it is possible to reduce the amount of refrigerant. In addition to the above, it is sufficient to connect the outdoor unit 1 and the respective indoor units 3 by pipes, so that a piping work can be easily performed.

REFERENCE SIGNS LIST

0 air-conditioning device 1 outdoor unit 2 relay unit 3, 3*a*, 3*b*, 3*c* indoor unit 5 heat medium pipe 6 refrigerant pipe 10 compressor 11 refrigerant flow passage switching device 12 heat-source-side heat exchanger 13 expansion device 14 accumulator 15 heat-source-side fan 21 heat medium heat exchanger 22 pump 23 inverter device 31, 31*a*, 31*b*, 31*c* indoor heat exchanger 32, 32*a*, 32*b*, 32*c* indoor flow control device 33, 33*a*, 33*b*, 33*c* indoor-side fan 100 outdoor unit control device 200 relay unit control device 210 control processing device 211 arithmetic processing unit

212 determination processing unit 213 selection processing unit 214 instruction processing unit 215 rotation setting unit 216 heat medium temperature setting unit 220 memory device 230 time measuring device

240 communication device 300, 300*a*, 300*b*, 300*c* indoor unit control device 501 discharge temperature sensor 502 discharge pressure sensor

503 outdoor temperature sensor 504 first refrigerant temperature sensor

505 second refrigerant temperature sensor 511 inflow-port-side heat medium temperature sensor 512 outflow-port-side heat medium temperature sensor 513, 513*a*, 513*b*, 513*c* inflow-port-side indoor temperature sensor

514, 514*a*, 514*b*, 514*c* outflow-port-side indoor temperature sensor 515, 515*a*, 515*b*, 515*c* indoor temperature sensor 521, 521*a*, 521*b*, 521*c* inflow-side indoor pressure sensor 522, 522*a*, 522*b*, 522*c* outflow-side indoor pressure sensor 523 pump-inflow-side pressure sensor 524 pump-outflow-side pressure sensor

The invention claimed is:

1. An air-conditioning device comprising:

a heat medium cycle circuit including:

a pump configured to pressurize a heat medium including water or brine, and forming a medium that delivers heat, a plurality of indoor heat exchangers configured to exchange heat between the heat medium and indoor air being an object to be air-conditioned, and a plurality of flow controllers provided corresponding to the plurality of indoor heat exchangers, and configured to control a flow rate of the heat medium passing through the plurality of indoor heat exchangers, the pump, the plurality of indoor heat exchangers, and the plurality of flow controllers being connected by pipes to allow the heat medium to cycle through the heat medium cycle circuit;

a heat-source-side refrigerant cycle circuit configured to heat or cool the heat medium to be fed to the plurality of indoor heat exchangers;

a plurality of heat medium temperature sensors corresponding to the plurality of indoor heat exchangers and configured to measure a heat medium temperature of the heat medium passing through a corresponding indoor heat exchanger;

a plurality of indoor temperature sensors corresponding to the plurality of indoor heat exchangers, each configured to measure an air temperature of air flowing into a corresponding indoor heat exchanger; and a controller configured to control equipment of the heat medium cycle circuit, wherein the controller includes a determination processor configured to determine whether the heat medium should be caused to pass through at least one of the plurality of indoor heat exchangers in which heat exchange has previously been stopped, a selection processor configured to select, based on a determination from the determination processor, at least one indoor heat exchanger through which the heat medium is caused to pass from the plurality of indoor heat exchangers in which heat exchange has previously been stopped, an instruction processor configured to instruct that at least one flow controller that corresponds to the selected at least one indoor heat exchanger be opened, and a rotation setting processor configured to set a rotation of the plurality of indoor heat exchangers selected by the selection processor, the heat medium being caused to pass through the plurality of indoor heat exchangers by switching the plurality of indoor heat exchangers, and the rotation setting processor is further configured to set the rotation of the plurality of indoor heat exchangers such that the heat medium is caused to pass through the plurality of indoor heat exchangers in order of increasing temperature difference between the temperature of the heat medium passing through the corresponding indoor heat exchanger and the temperature of the air flowing into the corresponding indoor heat exchanger.

2. The air-conditioning device of claim 1, wherein the controller further includes a heat medium temperature setting processor configured to set a temperature of the heat medium to be fed to the indoor heat exchanger in causing the heat medium to pass through the indoor heat exchanger that is in a stopped state.

3. The air-conditioning device of claim 1, wherein the heat-source-side refrigerant cycle circuit includes a heat-source-side refrigerant cycle circuit including a compressor configured to compress heat-source-side refrigerant, a heat-source-side heat exchanger configured to exchange heat between the heat-source-side refrigerant and outdoor air, an expansion device configured to decompress the heat-source-side refrigerant, and a heat medium heat exchanger configured to exchange heat between the heat-source-side refrigerant and the heat medium, the compressor, the heat-source-side heat exchanger, the expansion device, and the heat medium heat exchanger being connected by pipes.

4. The air-conditioning device of claim 3, wherein the controller causes the heat medium to cycle through the heat medium cycle circuit at a flow rate equal to or higher than a passing flow rate required at the heat medium heat exchanger.

5. The air-conditioning device of claim 3, wherein the compressor and the heat-source-side heat exchanger are provided to an outdoor unit, and the heat medium heat exchanger and the pump are provided to a relay configured to relay heat transfer between the outdoor unit and an indoor unit including the plurality of indoor heat exchangers.

6. The air-conditioning device of claim 3, wherein constituent equipment of the heat-source-side refrigerant cycle circuit and the pump are provided to an outdoor unit.

7. The air-conditioning device of claim 2, wherein the heat-source-side refrigerant cycle circuit includes a heat-source-side refrigerant cycle circuit including a compressor configured to compress heat-source-side refrigerant, a heat-source-side heat exchanger configured to exchange heat between the heat-source-side refrigerant and outdoor air, an expansion device configured to decompress the heat-source-side refrigerant, and a heat medium heat exchanger configured to exchange heat between the heat-source-side refrigerant and the heat medium, the compressor, the heat-source-side heat exchanger, the expansion device, and the heat medium heat exchanger being connected by pipes.

8. The air-conditioning device of claim 7, wherein the controller causes the heat medium to cycle through the heat medium cycle circuit at a flow rate equal to or higher than a passing flow rate required at the heat medium heat exchanger.

9. The air-conditioning device of claim 7, wherein the compressor and the heat-source-side heat exchanger are provided to an outdoor unit, and the heat medium heat exchanger and the pump are provided to a relay configured to relay heat transfer between the outdoor unit and an indoor unit including the plurality of indoor heat exchangers.

10. The air-conditioning device of claim 7, wherein constituent equipment of the heat-source-side refrigerant cycle circuit and the pump are provided to an outdoor unit.

11. The air-conditioning device of claim 1, wherein the controller further comprises a heat medium temperature setting processor configured to increase the temperature of the heat medium passing through the indoor heat exchanger that is in a stopped state when the heat medium is operating as a cooled medium, and decrease the temperature of the heat medium passing through the indoor heat exchanger that is in a stopped state when the heat medium is operating as a heated medium.

* * * * *